US008709990B2

(12) United States Patent
Hueffer et al.

(10) Patent No.: US 8,709,990 B2
(45) Date of Patent: Apr. 29, 2014

(54) FORMULATIONS, THEIR USE AS OR FOR PRODUCING DISHWASHING DETERGENTS AND THEIR PRODUCTION

(71) Applicants: Stephan Hueffer, Ludwigshafen (DE); Alejandra Garcia Marcos, Ludwigshafen (DE); Markus Hartmann, Neustadt (DE); Heike Weber, Mannheim (DE)

(72) Inventors: Stephan Hueffer, Ludwigshafen (DE); Alejandra Garcia Marcos, Ludwigshafen (DE); Markus Hartmann, Neustadt (DE); Heike Weber, Mannheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/655,012

(22) Filed: Oct. 18, 2012

(65) Prior Publication Data

US 2013/0102516 A1 Apr. 25, 2013

Related U.S. Application Data

(60) Provisional application No. 61/548,748, filed on Oct. 19, 2011.

(30) Foreign Application Priority Data

Feb. 21, 2012 (EP) ..... 12156369

(51) Int. Cl.
*C11D 3/37* (2006.01)
*C11D 1/83* (2006.01)

(52) U.S. Cl.
USPC ..... 510/223; 510/220; 510/224; 510/229; 510/361; 510/365; 510/367; 510/375; 510/480; 510/514

(58) Field of Classification Search
USPC ..... 510/220, 223, 224, 229, 361, 365, 367, 510/375, 480, 514
See application file for complete search history.

(56) References Cited

U.S. PATENT DOCUMENTS

| | | | | |
|---|---|---|---|---|
| 5,955,415 | A * | 9/1999 | Gutierrez et al. | 510/312 |
| 6,964,943 | B1 * | 11/2005 | Bettiol et al. | 510/392 |
| 2003/0232734 | A1 * | 12/2003 | Kitko et al. | 510/311 |
| 2012/0006358 | A1 * | 1/2012 | Warkotsch et al. | 134/18 |

FOREIGN PATENT DOCUMENTS

| | | | |
|---|---|---|---|
| DE | 198 19 187 | A1 | 11/1999 |
| DE | 101 04 469 | A1 | 8/2002 |
| EP | 0 851 023 | A2 | 7/1998 |
| WO | WO 97/49792 | | 12/1997 |
| WO | WO 02/064719 | A1 | 8/2002 |
| WO | WO 2010/020765 | A1 | 2/2010 |

OTHER PUBLICATIONS

U.S. Appl. No. 13/654,807, filed Oct. 18, 2012, Hueffer, et al.
U.S. Appl. No. 13/654,814, filed Oct. 18, 2012, Hueffer, et al.
W. Buchmeier et al., "Untersuchungen zur Spülgutkorrosion beim maschinellen Geschirrspülen", SÖFW-Journal, vol. 122, No. 6, 1996, pp. 398-405 (with English equivalent).
International Search Report issued Jan. 24, 2013, in PCT/EP2012/069040, filed Sep. 27, 2012 (with English translation).
U.S. Appl. No. 13/869,111, filed Apr. 24, 2013, Hueffer, et al.
U.S. Appl. No. 13/866,350, filed Apr. 19, 2013, Hueffer, et al.

* cited by examiner

*Primary Examiner* — Charles Boyer
(74) *Attorney, Agent, or Firm* — Oblon, Spivak, McClelland, Maier & Neustadt, L.L.P.

(57) ABSTRACT

Formulations comprising (A) at least one compound selected from aminocarboxylates and polyaminocarboxylates, (B) at least one homopolymer or copolymer of ethyleneimine, (C) sodium citrate and (D) at least one compound selected from alkali metal percarbonate, alkali metal perborate and alkali metal persulfate.

15 Claims, No Drawings

FORMULATIONS, THEIR USE AS OR FOR PRODUCING DISHWASHING DETERGENTS AND THEIR PRODUCTION

The present invention relates to formulations comprising (A) at least one compound selected from aminocarboxylates and polyaminocarboxylates, (B) at least one homopolymer or copolymer of ethyleneimine, (C) sodium citrate and (D) at least one compound selected from alkali metal percarbonate, alkali metal perborate and alkali metal persulfate.

Furthermore, the present invention relates to a process for producing formulations according to the invention and to their use as or for producing dishwashing detergents, in particular dishwashing detergents for machine dishwashing.

Dishwashing detergents have to meet many requirements. For example, they have to clean the dishes thoroughly, they should have no harmful or potentially harmful substances in the waste water, they should permit the running-off and drying of the water from the dishes, and they should not lead to problems during the operation of the dishwasher. Finally, they should not lead to esthetically undesirable results on the item to be cleaned. In this connection, glass corrosion is to be mentioned in particular.

Glass corrosion arises not only as a result of mechanical effects, for example as a result of glasses rubbing together or mechanical contact between the glasses and parts of the dishwasher, but is primarily promoted by chemical influences. For example, certain ions can be dissolved out of the glass as a result of repeated machine cleaning, which adversely alters the optical and thus esthetic properties.

Several effects are observed with glass corrosion. Firstly, the formation of microscopically fine cracks can be observed which become noticeable in the form of lines. Secondly, in many cases, general hazing can be observed, for example a roughening which makes the glass in question appear unattractive. Effects of this type are overall also subdivided into iridescent discoloration, scoring, as well as patchy and circular clouding.

It is known from WO 2002/64719 that certain copolymers of ethylenically unsaturated carboxylic acids with, for example, esters of ethylenically unsaturated carboxylic acids can be used in dishwashing detergents.

WO 2010/020765 discloses dishwashing detergents which comprise polyethyleneimine. Dishwashing detergents of this type can comprise phosphate or be phosphate-free. They are attributed good inhibition of glass corrosion. Zinc-containing and bismuth-containing dishwashing detergents are discouraged. Glass corrosion, in particular line corrosion and clouding, however, is in many cases still not adequately delayed or prevented.

It was therefore the object to provide formulations which are suitable as or for producing dishwashing detergents and which avoid the disadvantages known from the prior art and which inhibit glass corrosion or at least reduce it particularly well. It was also the object to provide a process for producing formulations which are suitable as or for producing dishwashing detergents and which avoid the disadvantages known from the prior art. It was also the object to provide uses of formulations.

Accordingly, the formulations defined at the outset have been found, also called for short formulations according to the invention.

Formulations according to the invention comprise (A) at least one compound selected from aminocarboxylates and polyaminocarboxylates, in the scope of the present invention also called for short aminocarboxylate (A) or polyaminocarboxylate (A) or else compound (A), and also derivatives and preferably salts thereof.

Compound (A) can be present as a free acid or preferably in partially or completely neutralized form, i.e. as a salt. Suitable counterions are, for example, inorganic cations, for example ammonium, alkali metal or alkaline earth metal, preferably $Mg^{2+}$, preferably $Na^{+}$, $K^{+}$, or organic cations, preferably ammonium substituted with one or more organic radicals, in particular triethanolammonium, N,N-diethanolammonium, N-mono-$C_1$-$C_4$-alkyldiethanolammonium, for example N-methyldiethanolammonium or N-n-butyldiethanolammonium, and N,N-di-$C_1$-$C_4$-alkylethanolammonium.

In one embodiment of the present invention, compound (A) is selected from derivatives of aminocarboxylates and polyaminocarboxylates, for example from methyl or ethyl esters.

Within the context of the present invention, aminocarboxylates (A) are understood as meaning nitrilotriacetic acid and those organic compounds which have a tertiary amino group which has one or two $CH_2$—COOH groups which—as mentioned above—can be partially or completely neutralized. Within the context of the present invention, polyaminocarboxylates (A) are understood as meaning those organic compounds which have at least two tertiary amino groups, each of which, independently of the other, has one or two $CH_2$—COOH groups which—as mentioned above—can be partially or completely neutralized.

In another embodiment of the present invention, aminocarboxylates (A) are selected from those organic compounds which have a secondary amino group which has one or two CH(COOH)$CH_2$—COOH group(s) which—as mentioned above—can be partially or completely neutralized. In another embodiment of the present invention, polyaminocarboxylates (A) are selected from those organic compounds which have at least two secondary amino groups, which each have one CH(COOH)$CH_2$—COOH group, which—as mentioned above—can be partially or completely neutralized.

Preferred polyaminocarboxylates (A) are selected from 1,2-diaminoethanetetracetic acid, tetraacetylmethylenediamine, tetraacetylhexylenediamine, iminodisuccinate (IDS), diethylenetriaminepentaacetate (DTPA), hydroxyethylenediaminetriacetate (HEDTA), and their respective salts, particularly preferably alkali metal salts, in particular the sodium salts.

Preferred aminocarboxylates (A) and polyaminocarboxylates (A) are nitrilotriacetic acid and those organic compounds which have a structure based on an amino acid, the amino group(s) of which has or have one or two $CH_2$—COOH groups and are tertiary amino groups. In this connection, amino acids can be selected from L-amino acids, R-amino acids and enantiomer mixtures of amino acids, for example the racemates.

In one embodiment of the present invention, compound (A) is selected from methylglycinediacetate (MGDA), nitrilotriacetic acid and glutamic acid diacetate, and derivatives thereof and preferably salts thereof, in particular the sodium salts thereof. Very particular preference is given to methylglycinediacetate and also the trisodium salt of MGDA.

The formulation according to the invention further comprises (B) at least one homopolymer of ethyleneimine, together for short also called polyethyleneimine (B).

According to a particular embodiment of the invention, polyethyleneimine (B) has an average molecular weight $M_n$ of from 500 g/mol to 125 000 g/mol, preferably from 750 g/mol to 100 000 g/mol.

In one embodiment of the present invention, polyethyleneimine (B) has an average molecular weight $M_w$ in the range from 500 to 1 000 000 g/mol, preferably in the range from 600 to 75 000 g/mol, particularly preferably in the range from 800 to 25 000 g/mol, determinable for example by gel permeation chromatography (GPC).

In one embodiment of the present invention, polyethyleneimines (B) are selected from highly branched polyethyleneimines. Highly branched polyethyleneimines (B) are characterized by their high degree of branching (DB). The degree of branching can be determined for example by $^{13}$C-NMR spectroscopy, preferably in $D_2O$, and is defined as follows:

$$DB=D+T/D+T+L$$

with D (dendritic) corresponding to the fraction of tertiary amino groups, L (linear) corresponding to the fraction of secondary amino groups and T (terminal) corresponding to the fraction of primary amino groups.

Within the context of the present invention, highly branched polyethyleneimines (B) are polyethyleneimines (B) with DB in the range from 0.1 to 0.95, preferably 0.25 to 0.90, particularly preferably in the range from 0.30 to 0.80 and very particularly preferably at least 0.5.

Within the context of the present invention, dendrimeric polyethyleneimines (B) are polyethyleneimines (B) with a structurally and molecularly uniform constitution.

In one embodiment of the present invention, polyethyleneimine (B) is highly branched polyethyleneimines (homopolymers) with an average molecular weight $M_w$ in the range from 600 to 75 000 g/mol, preferably in the range from 800 to 25 000 g/mol.

According to a particular embodiment of the invention, polyethyleneimine (B) is highly branched polyethyleneimines (homopolymers) with an average molecular weight $M_n$ of from 500 g/mol to 125 000 g/mol, preferably from 750 g/mol to 100 000 g/mol, which is selected from dendrimers.

Formulations according to the invention further comprise sodium citrate (C). Here, the term sodium citrate includes the mono- and preferably the disodium salt. Sodium citrate can be used as the anhydrous salt or as the hydrate, for example as the dihydrate.

Formulations according to the invention further comprise (D) at least one compound selected from alkali metal percarbonate, alkali metal perborate and alkali metal persulfate, within the scope of the present invention also called "bleach (D)".

Preferred bleaches (D) are selected from sodium perborate, anhydrous or, for example, as the monohydrate or as the tetrahydrate or so-called dihydrate, sodium percarbonate, anhydrous or, for example, as the monohydrate, and sodium persulfate, where the term "persulfate" in each case includes the salt of the peracid $H_2SO_5$ and also the peroxodisulfate.

In this connection, the alkali metal salts can in each case also be alkali metal hydrogen carbonate, alkali metal hydrogen perborate and alkali metal hydrogen persulfate. However, the dialkali metal salts are preferred in each case.

In one embodiment of the present invention, formulations according to the invention comprise in total in the range from 1 to 50% by weight of compound (A), preferably 10 to 25% by weight, in total 0.05 to 2% by weight of homopolymer of ethyleneimine (B), preferably 0.1 to 0.5% by weight, 1 to 50% by weight of sodium citrate (C), preferably 5 to 30% by weight, determined as anhydrous sodium citrate, in total 0.5 to 15% by weight of bleach (D), selected from alkali metal percarbonate, alkali metal perborate and alkali metal persulfate, based in each case on the solids content of the formulation in question.

In one embodiment of the present invention, the formulation according to the invention is solid at room temperature, for example a powder or a tablet. In another embodiment of the present invention, the formulation according to the invention is liquid at room temperature. In one embodiment of the present invention, the formulation according to the invention is granules, a liquid preparation or a gel.

In one embodiment of the present invention, the formulation according to the invention comprises 0.1 to 10% by weight of water, based on the sum of all solids in the formulation in question.

In one embodiment of the present invention, the formulation according to the invention is free from phosphates and polyphosphates, with hydrogenphosphates being subsumed, for example free from trisodium phosphate, pentasodium tripolyphosphate and hexasodium metaphosphate. In connection with phosphates and polyphosphates, "free from" should be understood within the context of the present invention as meaning that the content of phosphate and polyphosphate is in total in the range from 10 ppm to 0.2% by weight, determined by gravimetry.

In one embodiment of the present invention, the formulation according to the invention is free from those heavy metal compounds which do not act as bleach catalysts, in particular from compounds of ion and of bismuth. In connection with heavy metal compounds, within the context of the present invention, "free from" should be understood as meaning that the content of heavy metal compounds which do not act as bleach catalysts is in total in the range from 0 to 100 ppm, determined in accordance with the Leach method.

Within the context of the present invention, "heavy metals" are all metals having a specific density of at least 6 g/cm$^3$. In particular, heavy metals are precious metals and also zinc, bismuth, iron, copper, lead, tin, nickel, cadmium and chromium.

Preferably, the formulation according to the invention comprises no measurable fractions of zinc and bismuth compounds, i.e. for example less than 1 ppm.

In one embodiment of the present invention, the formulation according to the invention can have further ingredients (E), for example one or more surfactants, one or more enzymes, one or more builders, in particular phosphorus-free builders, one or more cobuilders, one or more alkali carriers, one or more bleaches, one or more bleach catalysts, one or more bleach activators, one or more bleach stabilizers, one or more antifoams, one or more corrosion inhibitors, one or more builder substances, buffers, dyes, one or more fragrances, one or more organic solvents, one or more tableting auxiliaries, one or more disintegrants, one or more thickeners, or one or more solubility promoters.

Examples of surfactants are in particular nonionic surfactants and also mixtures of anionic or zwitterionic surfactants with nonionic surfactants. Preferred nonionic surfactants are alkoxylated alcohols and alkoxylated fatty alcohols, di- and multiblock copolymers of ethylene oxide and propylene oxide and reaction products of sorbitan with ethylene oxide or propylene oxide, alkyl glycosides and so-called amine oxides.

Preferred examples of alkoxylated alcohols and alkoxylated fatty alcohols are, for example, compounds of the general formula (I)

(I)

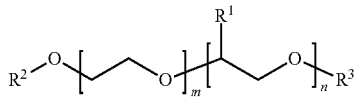

in which the variables are defined as follows:

$R^1$ is selected from linear $C_1$-$C_{10}$-alkyl, preferably ethyl and particularly preferably methyl, $R^2$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from Craw-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Here, compounds of the general formula (I) may be block copolymers or random copolymers, preference being given to block copolymers.

Other preferred examples of alkoxylated alcohols and alkoxylated fatty alcohols are, for example, compounds of the general formula (II)

(II)

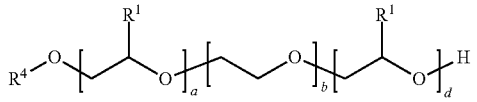

in which the variables are defined as follows:

$R^1$ is identical or different and selected from linear $C_1$-$C_4$-alkyl, preferably identical in each case and ethyl and particularly preferably methyl, $R^4$ is selected from $C_6$-$C_{20}$-alkyl, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from 1 to 6, b is a number in the range from 4 to 20, c is a number in the range from 4 to 25.

Here, compounds of the general formula (II) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

Mixtures of two or more different nonionic surfactants may also be present.

Examples of anionic surfactants are $C_8$-$C_{20}$-alkyl sulfates, $C_8$-$C_{20}$-alkyl sulfonates and $C_8$-$C_{20}$-alkyl ether sulfates with one to 6 ethylene oxide units per molecule.

In one embodiment of the present invention, the formulation according to the invention can comprise in the range from 3 to 20% by weight of surfactant.

Formulations according to the invention can comprise one or more enzymes. Examples of enzymes are lipases, hydrolases, amylases, proteases, cellulases, esterases, pectinases, lactases and peroxidases.

Formulations according to the invention can comprise, for example, up to 5% by weight of enzyme, preference being given to 0.1 to 3% by weight, in each case based on the total solids content of the formulation according to the invention.

Over and above sodium citrate, formulations according to the invention can comprise one or more builders, in particular phosphate-free builders. Examples of suitable builders are silicates, in particular sodium disilicate and sodium metasilicate, zeolites, sheet silicates, in particular those of the formula $\alpha$-$Na_2Si_2O_5$, $\beta$-$Na_2Si_2O_5$, and $\delta$-$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

In one embodiment of the present invention, builders are selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates, in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol(meth)acrylate, methoxypolypropylene glycol(meth)acrylate, methoxypolybutylene glycol(meth)acrylate, methoxypoly(propylene oxide-co-ethylene oxide)(meth)acrylate, ethoxypolyethylene glycol (meth)acrylate, ethoxypolypropylene glycol(meth)acrylate, ethoxypolybutylene glycol(meth)acrylate and ethoxypoly (propylene oxide-co-ethylene oxide)(meth)acrylate. Polyalkylene glycols here can comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

Moreover, amphoteric polymers can also be used as builders.

Formulations according to the invention can comprise, for example, in the range from in total 10 to 50% by weight, preferably up to 20% by weight, of builders.

In one embodiment of the present invention, formulations according to the invention can comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular importance as a cobuilder. It is preferably used as the sodium salt, the disodium salt giving a neutral reaction and the tetrasodium salt an alkaline reaction (pH 9). Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as hexasodium salt of EDTMP or as hepta- and octasodium salt of DTPMP.

Formulations according to the invention can comprise one or more alkali carriers. Alkali carriers ensure, for example, a pH of at least 9 if an alkaline pH is desired. Of suitability are, for example, alkali metal carbonates, alkali metal hydrogen carbonates, alkali metal hydroxides and alkali metal metasilicates. A preferred alkali metal is in each case potassium, particular preference being given to sodium.

Besides bleach (D), formulations according to the invention comprise one or more chlorine-containing bleaches.

Suitable chlorine-containing bleaches are, for example, 1,3-dichloro-5,5-dimethylhydantoin, N-N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations according to the invention can comprise, for example, in the range from 3 to 10% by weight of chlorine-containing bleach.

Formulations according to the invention can comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Formulations according to the invention can comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts).

Formulations according to the invention can comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, formulations according to the invention comprise in total in the range from 0.1 to 1.5% by weight of corrosion inhibitor.

Formulations according to the invention can comprise one or more builder substances, for example sodium sulfate.

Formulations according to the invention can comprise one or more antifoams, selected for example from silicone oils and paraffin oils.

In one embodiment of the present invention, formulations according to the invention comprise in total in the range from 0.05 to 0.5% by weight of antifoam.

Formulations according to the invention can comprise phosphonic acid or one or more phosphonic acid derivatives, for example hydroxyethane-1,1-diphosphonic acid.

The present invention further provides the use of formulations according to the invention for the machine cleaning of dishes and kitchen utensils. Within the scope of the present invention, kitchen utensils which may be mentioned are, for example, pots, pans, casseroles, also objects made of metal such as, for example, slotted spoons, fish slices and garlic presses.

Preference is given to the use of formulations according to the invention for the machine cleaning of objects which have at least one surface made of glass, which may be decorated or undecorated. In this connection, within the context of the present invention, a surface made of glass is to be understood as meaning that the object in question has at least one section made of glass which comes into contact with the ambient air and can become soiled upon use of the object. Thus, the objects in question may be those which, like drinking glasses or glass bowls, are essentially made of glass. However, they may, for example, also be lids which have individual components made of a different material, for example pot lids with rim and handle made of metal.

Surfaces made of glass can be decorated, for example colored or imprinted, or be undecorated.

The term "glass" includes any desired types of glass, for example lead glass and in particular soda-lime glass, crystal glass and borosilicate glasses.

Preferably, machine cleaning is washing with a dishwasher (automatic dishwashing).

In one embodiment of the present invention, at least one formulation according to the invention is used for the machine cleaning of drinking glasses, glass vases and glass vessels for cooking.

In one embodiment of the present invention, for the cleaning, water with a hardness in the range from 1 to 30° German hardness, preferably 2 to 25° German hardness is used, with German hardness being understood in particular as meaning the calcium hardness.

If formulations according to the invention are used for machine cleaning, then even in the case of repeated machine cleaning of objects which have at least one surface made of glass, only a very slight tendency towards glass corrosion is observed, and only then if objects which have at least one surface made of glass are cleaned together with heavily soiled cutlery or dishes. Furthermore, it is significantly less harmful to use the formulation according to the invention to clean glass together with objects made of metal, for example together with pots, pans or garlic presses.

Furthermore, it can be observed that formulations according to the invention have a very good bleaching effect when used for washing dishes and kitchen utensils and glass surfaces.

The present invention further provides a process for producing formulations according to the invention, for short also called production process according to the invention. To carry out the production process according to the invention, the procedure may, for example, be such that (A) at least one compound selected from aminocarboxylates and polyaminocarboxylates, and salts and derivatives thereof, (B) at least one salt of bismuth, (C) at least one homopolymer or copolymer of ethyleneimine and optionally further components (E) are mixed, for example stirred, in one or more steps with one another in the presence of water, and then the water is removed, completely or at least partially.

Compound (A), salt of bismuth (B) and polyethyleneimine (C) are defined above.

In one embodiment of the present invention, before the water is at least partially removed, mixing with one or more further ingredients (E) for the formulation according to the invention is possible, for example with one or more surfactants, one or more enzymes, one or more builders, one or more cobuilders, in particular phosphorus-free builders, one or more alkali carriers, one or more bleaches, one or more bleach catalysts, one or more bleach activators, one or more bleach stabilizers, one or more antifoams, one or more corrosion inhibitors, one or more builder substances, with buffer or dye.

In one embodiment, the procedure involves removing the water from the formulation according to the invention entirely or partially, for example to a residual moisture in the range from zero to 5% by weight, by evaporating it, in particular by means of spray-drying, spray granulation or compaction.

In one embodiment of the present invention, the water is removed, completely or partially, at a pressure in the range from 0.3 to 2 bar.

In one embodiment of the present invention, the water is removed, completely or partially, at temperatures in the range from 60 to 220° C.

By means of the production process according to the invention, formulations according to the invention can be obtained easily.

The cleaning formulations according to the invention can be provided in liquid or solid form, in a single-phase or multiphase, as tablets or in the form of other dosage units, in packaged or unpackaged form. The water content of liquid formulations can vary from 35 to 90% water.

The invention is illustrated by working examples.

General: It was ensured that after the first cleaning of the test bodies in the domestic dishwasher until after the weighing and visual inspection of the glasses, the test bodies were handled only with clean cotton gloves so that the weight and/or the visual impression of the test bodies was not falsified.

I. Preparation of Formulations According to the Invention

I.1 Preparation of Basis Mixtures

Firstly, basis mixtures were prepared which comprised the feed materials according to table 1. The feed materials were mixed dry.

TABLE 1

Basis mixtures for experiments with formulations according to the invention and comparison formulations

| | Basis-1 | Basis-2 | Basis-3 |
|---|---|---|---|
| Protease | 2.5 | 2.5 | 2.5 |
| Amylase | 1 | 1 | 1 |
| n-$C_{18}H_{37}(OCH_2CH_2)_9OH$ | 5 | 5 | 5 |
| Polyacrylic acid $M_w$ 4000 g/mol as sodium salt, completely neutralized | 10 | 10 | 10 |
| Sodium percarbonate (D.1) | 10.5 | 10.5 | 10.5 |
| TAED | 4 | 4 | 4 |
| $Na_2Si_2O_5$ | 2 | 2 | 2 |
| $Na_2CO_3$ | 19.5 | 19.5 | 19.5 |
| Sodium citrate dihydrate (C.1) | 5 | 22.5 | 30 |
| HEDP | 0.5 | 0.5 | 0.5 |

All quantitative data in g

Abbreviations:

MGDA: Methylglycinediacetic acid as trisodium salt

TAED: N,N,N',N'-tetraacetylethylenediamine

HEDP: Disodium salt of hydroxyethane (1,1-diphosphonic acid)

I.2 Preparation of Formulations According to the Invention 20 ml of distilled water were introduced as initial charge in a 100 ml beaker, and the following were added in succession with stirring:

Polyethyleneimine (B.1), (B.2), (B.3), (B.4) or (B.5) according to table 2 (or 3)

The mixture was stirred for 10 minutes at room temperature. MGDA-trisodium salt (A.1), dissolved in 30 ml of water, as per table 2 (or 3) was then added. This gave a clearly transparent solution. The basis mixture as per table 2 (or 3) was then added, the mixture was stirred again and the water was evaporated.

This gave formulations according to the invention which were tested according to table 2 (or 3). To prepare comparison formulations, the procedure was analogous but leaving the polyethyleneimine (B) out or using a copolymer of ethyleneimine.

If, in the test "Dishwasher with continuous operation" (or in the immersion test), the corresponding fractions of basis mixture are metered in separately from aqueous solution of (A.1), (B), (C.1) or (D.1), the same results are obtained as when the dried formulation with the same amounts of active ingredients was tested. The order of the metered addition is therefore of no consequence.

(B.1): polyethyleneimine homopolymer, $M_w$ 800 g/mol, DB 0.63

(B.2): polyethyleneimine homopolymer, $M_w$ 2000 g/mol, DB 0.64

(B.3): polyethyleneimine homopolymer, $M_w$ 5000 g/mol, DB 0.67

(B.4): polyethyleneimine homopolymer, $M_w$ 25 000 g/mol, DB 0.7

(B.5) polyethyleneimine homopolymer, $M_w$ 750 000 g/mol, DB 0.69

(B.6) polyethyleneimine, ethoxylated (B.7) polyethyleneimine, carboxymethylated, sodium salt, functionalization 80 mol % of the primary amino groups, $M_w$ 50 000 g/mol (after carbomethoxylation)

II. Use of Formulations According to the Invention and Comparison Formulations for the Machine Cleaning of Glasses The testing of formulations according to the invention and comparison formulations was carried out as follows.

II.1 Test Method for Dishwasher with Continuous Operation

Dishwasher: Miele G 1222 SCL

Program: 65° C. (with prewash)

Ware: 3 "GILDE" champagne glasses, 3 "INTERMEZZO" brandy glasses

For the cleaning, the glasses were arranged in the upper crockery basket of the dishwasher. The dishwashing detergent used was in each case 25 g of formulation according to the invention or comparison formulation according to table 2, where table 2 specifies the active components (A.1), basis mixture (including (C.1) and (D.1) and optionally (B)) of formulation according to the invention in each case individually. Washing was carried out at a clear-rinse temperature of 55° C. The water hardness was in each case in the range from 0 to 2° German hardness. Washing was carried out in each case for 100 wash cycles, i.e. the program was left to run 100×. The evaluation was made gravimetrically and visually after 100 wash cycles.

The weight of the glasses was determined before the start of the first wash cycle and after drying after the last wash cycle. The weight loss is the difference in the two values.

As well as the gravimetric evaluation, a visual assessment of the ware after 100 cycles in a darkened chamber with light behind a perforated plate was awarded using a grading scale from 1 (very poor) to 5 (very good). In this connection, grades were determined in each case for patchy corrosion/clouding and/or line corrosion.

II.2 Test Method for Immersion Test

Equipment:

Stainless steel pot (volume ca. 6 liters) with lid with hole for contact thermometer Grid base insert with holder for the stainless steel pot Magnetic stirrer with stirrer rod, contact thermometer, rubber stopper with hole Experimental Conditions:

Temperature: 75° C.

Time: 72 hours 5 liters of distilled water or water with defined water hardness ("hardness water")

The test bodies used were in each case one champagne glass and one brandy glass from Libbey (NL), material: lime-soda glasses.

Experimental Procedure:

Firstly, for the purposes of pretreatment, the test bodies were washed in a domestic dishwasher (Bosch SGS5602) with 1 g of surfactant (n-$C_{18}H_{37}(OCH_2CH_2)_{10}OH$) and 20 g of citric acid in order to remove any soilings. The test bodies were dried, their weight was determined and they were fixed to the grid base insert.

The stainless steel pot was filled with 5.5 liters of water and 25 g of formulation according to the invention or comparison formulation were added; table 3 specifies the active components (A.1), optionally (B), optionally (C) and basis mixture of formulation according to the invention or comparison formulation in each case individually. The cleaning liquor obtained in this way was stirred using the magnetic stirrer at 550 revolutions per minute. The contact thermometer was installed and the stainless steel pot was covered with the lid so that no water could evaporate during the experiment. It was heated to 75° C. and the grid base insert with the two test bodies was inserted into the stainless steel pot, it being ensured that the test bodies were completely immersed in the liquid.

When the experiment was complete, the test bodies were removed and rinsed under running distilled water. The test bodies were then washed in the domestic dishwasher using a formulation consisting of 1 g of surfactant (n-$C_{18}H_{37}(OCH_2CH_2)_{10}OH$) and 20 g of citric acid, again on the 55° C. program, in order to remove any deposits.

To assess the gravimetric abrasion, the dry test bodies were weighed. The visual assessment of the test bodies was then made. For this, the surface of the test bodies was assessed with regard to line corrosion (cord lines) and clouding corrosion (patchy clouding).

The assessments were carried out according to the following scheme.

Line Corrosion:

L5: no lines evident

L4: slight line formation in a very few areas, fine line corrosion

L3: line corrosion in some areas

L2: line corrosion in a number of areas

L1: pronounced line corrosion

Glass Clouding

L5: no clouding evident

L4: slight clouding in a very few areas

L3: clouding in some areas

L2: clouding in a number of areas

L1: pronounced clouding over virtually the entire glass surface

In the case of the inspection, interim grades (e.g. L3-4) were also allowed.

If, instead of water, hardness water with 2° German hardness was used for the tests, then formulations according to the invention were likewise always superior to the corresponding comparison formulations as far as inhibiting the glass corrosion is concerned.

II.3 Results

The results are summarized in tables 2 and 3.

TABLE 2

Results of the tests with dishwasher (continuous operation)

| Example No. | Basis mixture: [g] | (A.1) [g] | (B) [mg] | Weight loss Champagne glass [mg] | Weight loss Brandy glass [mg] | Visual assessment Champagne glass | Visual assessment Brandy glass |
|---|---|---|---|---|---|---|---|
| C-1 | Basis-3: 21.25 | 3.75 | — | 42.60 | 22.70 | L1-2, T1-2 | L2, T2 |
| 2 | Basis-3: 21.25 | 3.75 | 30 (B.2) | 11 | 7 | L3-4, T4-5 | L4, T4-5 |
| 3 | Basis-3: 21.25 | 3.75 | 15 (B.2) | 13 | 8 | L3, T4-5 | L3-4, T4-5 |
| 4 | Basis-2: 19.37 | 5.63 | 30 (B.2) | 14 | 8 | L3, T4-5 | L3-4, T4-5 |
| 5 | Basis-2: 19.37 | 5.63 | 15 (B.2) | 17 | 10 | L3, T4-5 | L2-3, T4-5 |
| 6 | Basis-1: 15.0 | 10.0 | 30 (B.2) | 21 | 12 | L2-3, T4-5 | L2-3, T4 |
| 7 | Basis-1: 15.0 | 10.0 | 15 (B.2) | 23 | 14 | L2-3, T4 | L2-3, T4 |

TABLE 2-continued

Results of the tests with dishwasher (continuous operation)

| Example No. | Basis mixture: [g] | (A.1) [g] | (B) [mg] | Weight loss Champagne glass [mg] | Weight loss Brandy glass [mg] | Visual assessment Champagne glass | Visual assessment Brandy glass |
|---|---|---|---|---|---|---|---|
| 8 | Basis-3: 21.25 | 3.75 | 30 (B.1) | 9 | 6 | L4, T5 | L4, T5 |
| 9 | Basis-3: 21.25 | 3.75 | 15 (B.1) | 12 | 9 | L3-4, T5 | L4, T4-5 |

TABLE 3

Immersion tests

| Example No. | Basis mixture: [g] | (A.1) [g] | (B) [mg] | Weight loss Champagne glass [mg] | Weight loss Brandy glass [mg] | Visual assessment Champagne glass | Visual assessment Brandy glass |
|---|---|---|---|---|---|---|---|
| C-1 | Basis-3: 21.25 | 3.75 | — | 167 | 98 | L2, T2 | L2, T2 |
| 2 | Basis-3: 21.25 | 3.75 | 30 (B.5) | 148 | 92 | L2-3, T2-3 | L2, T2-3 |
| 3 | Basis-3: 21.25 | 3.75 | 30 (B.4) | 100 | 55 | L3, T4-5 | L3, T4-5 |
| 4 | Basis-3: 21.25 | 3.75 | 30 (B.3) | 70 | 38 | L3, T4-5 | L3-4, T4-5 |
| 5 | Basis-3: 21.25 | 3.75 | 30 (B.2) | 62 | 33 | L3-4, T5 | L4, T4-5 |
| 6 | Basis-3: 21.25 | 3.75 | 30 (B.1) | 58 | 31 | L3-4, T5 | L4, T5 |
| C-7 | Basis-3: 21.25 | 3.75 | 30 (B.6) | 152 | 89 | L2-3, T2-3 | L2, T2-3 |
| C-8 | Basis-3: 21.25 | 3.75 | 30 (B.7) | 122 | 75 | L2-3, T3-4 | L2, T3-4 |
| 9 | Basis-3: 21.25 | 3.75 | 7.5 (B.1) | 73 | 40 | L2-3, T4-5 | L2, T4-5 |
| 10 | Basis-3: 21.25 | 3.75 | 12 (B.1) | 68 | 39 | L2-3, T4-5 | L2-3, T4-5 |
| 11 | Basis-3: 21.25 | 3.75 | 16.5 (B.1) | 63 | 35 | L3, T4-5 | L3, T4-5 |
| 12 | Basis-3: 21.25 | 3.75 | 24 (B.1) | 60 | 33 | L3-4, T5 | L4, T4-5 |

The invention claimed is:

1. A formulation, comprising:

(A) in total, from 10 to 50% by weight of at least one compound selected from the group consisting of methylglycine diacetate (MGDA), nitrilotriacetic acid, glutamic acid diacetate, a salt of methylglycine diacetate, a salt of nitrilotriacetic acid, a salt of glutamic acid diacetate, a derivative of methylglycine diacetate, a derivative of nitrilotriacetic acid and a derivative of glutamic acid diacetate, and (B) in total, from 0.05 to 2% by weight of at least one ethyleneimine homopolymer, (C) in total, from 1 to 50% by weight of sodium citrate, and (D) in total, from 0.5 to 15% by weight of at least one compound selected from the group consisting of alkali metal percarbonate, alkali metal perborate and alkali metal persulfate, based in each case on the solids content of said formulation.

2. The formulation according to claim 1, which is free from a phosphate and a polyphosphate.

3. The formulation according to claim 1, wherein (B) is selected from the group consisting of linear homopolymers of ethyleneimine and branched homopolymers of ethyleneimine.

4. The formulation according to claim 1, which has a heavy metal content below 0.05 ppm, based on the solids content of said formulation.

5. The formulation according to claim 1, which is solid at room temperature.

6. The formulation according to claim 1, which comprises from 0.1 to 10% by weight of water.

7. A method for washing dishes, and kitchen utensils or both, comprising:

contacting said dishes, kitchen utensils or both with a formulation according to claim 1.

8. A method for washing an object, comprising:

contacting said object with a formulation according to claim 1, wherein said object has at least one surface comprising glass, which is optionally decorated.

9. The method according to claim 7, wherein the washing is washing using a dishwasher.

10. The method according to claim 8, wherein said object is selected from the group consisting of drinking glasses, glass vases and glass vessels for cooking.

11. A process for producing a formulation according to claim 1, comprising:

mixing, in one or more steps, components A-D with one another, and optionally further components, in the presence of water, and then removing the water.

12. The process according to claim 11, wherein the water is removed by spray-drying.

13. The method according to claim 8, wherein the washing is washing using a dishwasher.

14. The method according to claim 8, wherein said surface is decorated.

15. The formulation according to claim 1 which is a dishwashing detergent capable of reducing glass corrosion.

* * * * *